US005369901A

United States Patent [19]

Revlett

[11] Patent Number: 5,369,901

[45] Date of Patent: Dec. 6, 1994

[54] REFRIGERATOR DOOR STRUCTURE TO REDUCE THERMAL BOW

[75] Inventor: John R. Revlett, Henderson County, Ky.

[73] Assignee: Whirlpool Corporation, Benton Harbor, Mich.

[21] Appl. No.: 13,504

[22] Filed: Feb. 4, 1993

[51] Int. Cl.[5] ..... F25D 11/00

[52] U.S. Cl. ..... 40/405; 40/406; 49/501

[58] Field of Search ..... 312/401, 405, 405.1, 312/406, 406.1, 406.2, 408, 321.5; 49/501

[56] References Cited

U.S. PATENT DOCUMENTS

| | | | |
|---|---|---|---|
| 2,718,446 | 9/1955 | Hinkel . | |
| 4,134,626 | 1/1979 | Kordes | 312/406.2 |
| 4,498,713 | 2/1985 | Fellwock et al. . | |
| 4,740,042 | 4/1988 | Stich et al. . | |
| 4,801,182 | 1/1989 | Metcalfe et al. | 312/321.5 |
| 4,914,341 | 4/1990 | Weaver et al. . | |
| 5,033,182 | 7/1991 | Winterheimer et al. . | |

FOREIGN PATENT DOCUMENTS

| | | | |
|---|---|---|---|
| 1061618 | 4/1954 | France | 312/406.2 |

*Primary Examiner*—Brian K. Green

*Attorney, Agent, or Firm*—Thomas J. Roth; Joel M. Van Winkle; Robert O. Rice

[57] ABSTRACT

A refrigerator door includes an outer metal shell having an outer rectangular panel connected to four inwardly turned side panels connected to an inwardly facing peripheral flange. An inner liner has a peripheral flange in registry with the outer door shell flange, a central wall and a pair of vertical, inwardly projecting sidewalls connecting the central wall to the liner flange. Each sidewall includes a scallop in the form of an inwardly opening notch at a select aligned longitudinal position of the inner liner. The central wall includes a transverse inwardly opening recess groove extending between the sidewalls at the select longitudinal position to provide an expansion joint to prevent bowing when an insulation cures in the space between the liner and the shell and when the refrigerator is in operation, thus cooling the door. Moreover, C-shaped beams in the door aid in providing strength to further prevent bowing.

15 Claims, 2 Drawing Sheets

FIG. 1
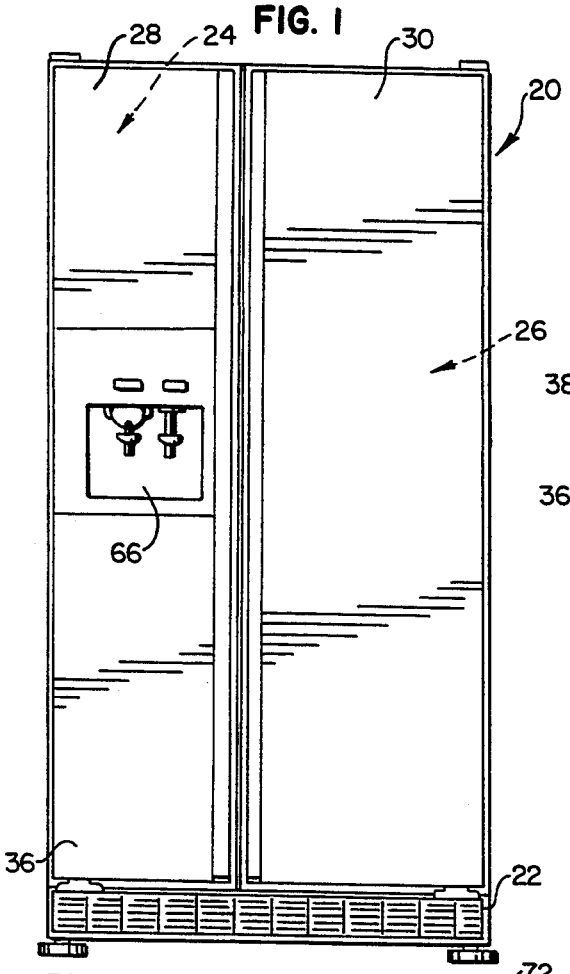
FIG. 2
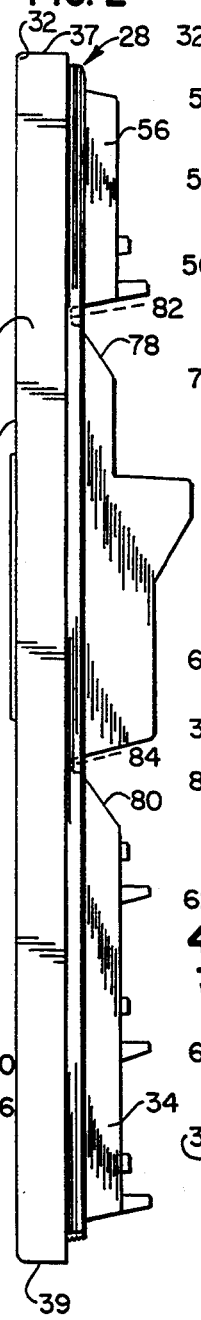
FIG. 3
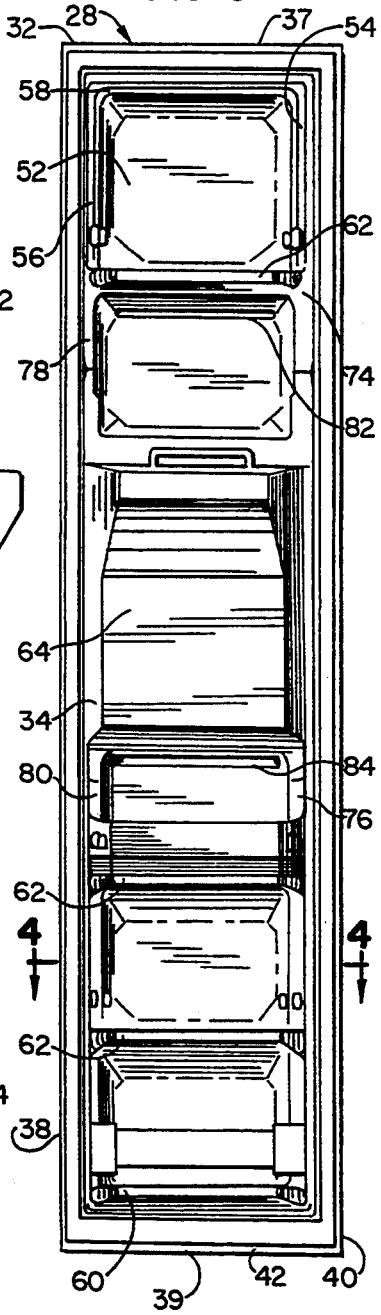
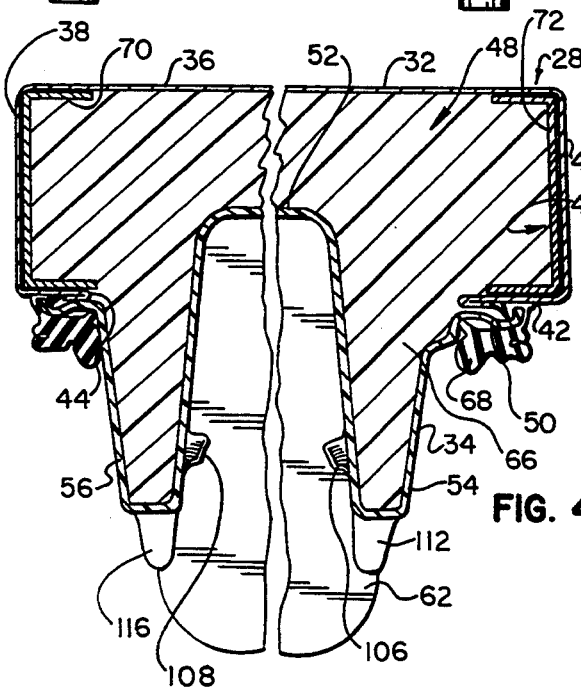
FIG. 4

REFRIGERATOR DOOR STRUCTURE TO REDUCE THERMAL BOW

FIELD OF THE INVENTION

This invention relates generally to a refrigeration apparatus and, more particularly, to an improved refrigerator cabinet door construction.

BACKGROUND OF THE INVENTION

A refrigeration apparatus typically includes a cabinet having an internal storage space accessible through an access opening. A door is hingedly mounted to the cabinet for selectively closing the access opening. Such a door usually comprises a metal outer shell fastened to an inner liner, the inner liner including shelves and the like for storing articles to be refrigerated. A body of insulation is provided in the space between the liner and the door shell. Advantageously, the insulation is a body of rigid, in situ foam insulation to attain better insulating values.

When a refrigerator door, such as described above, is filled with polyurethane foam during the insulation process, a bimetal effect takes place as the door cools, causing the door to bow longitudinally.

The present invention is intended to overcome one or more of the problems set forth above, in a novel and simple manner.

SUMMARY OF THE INVENTION

In accordance with one aspect of the invention, a flexible geometric shape is provided to the interior door panel so that it can flex and stretch to accommodate thermal contraction from the bimetal effect without causing the exterior door to bow.

In accordance with another aspect of the invention, the exterior door panel is reinforced with steel C-channels to reduce bowing.

Broadly, there is disclosed herein a door providing selective access to a refrigerated storage space. The door includes an outer metal shell having an outer rectangular panel connected to four inwardly turned side panels connected to an inwardly facing peripheral flange. An inner liner has a peripheral flange in registry with the outer door shell flange, a central wall and a pair of vertical, inwardly projecting sidewalls connecting the central wall to the liner flange. Each sidewall includes a scallop in the form of an inwardly opening notch at a select aligned longitudinal position of the inner liner. The central wall includes a transverse inwardly opening recess groove extending between the sidewalls at the select longitudinal position to provide an expansion joint.

It is a feature of the invention that the inner door panel comprises a unitary molded plastic panel.

It is another feature of the invention that the notch comprises a V-shaped indentation.

It is a further feature of the invention that the groove is longitudinally aligned with a narrowmost portion of the indentation.

It is another feature of the invention that each sidewall includes a second scallop in the form of an inwardly opening notch at a second select aligned longitudinal position of the inner liner, and the central wall includes a second transverse inwardly opening recessed groove extending between the sidewalls at the second select longitudinal position to provide a further expansion joint.

It is a further feature of the invention to provide a body of insulation disposed between the shell and the liner.

It is a further feature of the invention to provide a body of in situ foam insulation substantially filling the space between the shell and the liner.

In accordance with another aspect of the invention there is disclosed a door comprising an outer metal shell having an outer rectangular panel connected to four inwardly turned side panels connected to an inwardly facing peripheral flange to define a channel surrounding an inner space. A pair of elongate C-shaped beams are disposed at opposite vertical sides of the channel in registry with opposite vertical ones of the side panels. An inner liner is fastened to the outer door shell flange.

It is a feature of the invention that the beams are of a size in cross-section slightly smaller than a corresponding sides of the channel in cross-section and the beams are held in the channel with an interference fit.

Further features and advantages of the invention will readily be apparent from the specification and from the drawing.

BRIEF DESCRIPTION OF THE DRAWING

FIG. 1 is a front elevation view of a refrigerator embodying the invention;

FIG. 2 is a side elevation view of a freezer door of the refrigerator of FIG. 1;

FIG. 3 is an inside elevation view of the door of FIG. 2;

FIG. 4 is a partial sectional view taken along the line 4—4 of FIG. 3;

DETAILED DESCRIPTION OF THE INVENTION

Figure 7:
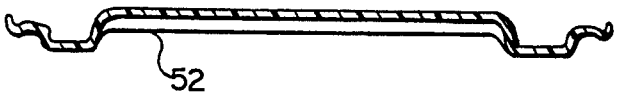
FIG. 7 is a sectional view taken along the line 7—7 of FIG. 5.
Figure 5:
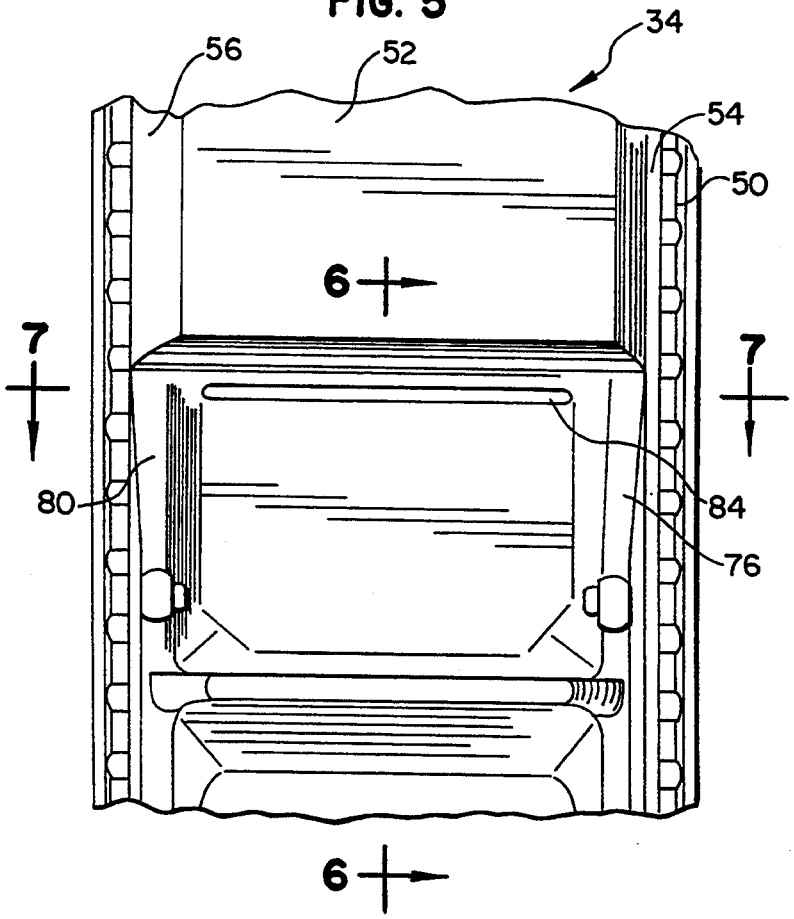
FIG. 5 is an enlarged view of a portion of the inner side of the liner of the door of FIGS. 2 and 3.
Figure 6:
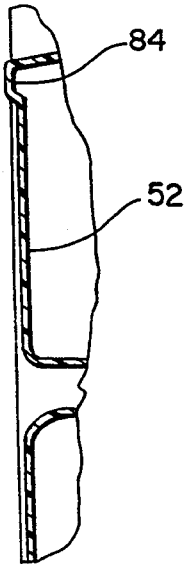
FIG. 6 is a sectional view taken along the line 6—6 of FIG. 5.

Referring to FIG. 1, a refrigeration apparatus, such as a refrigerator/freezer 20, includes a cabinet having a reinforced door construction.

The refrigerator/freezer 20 includes a cabinet 22 provided with an internal liner and an insulating separator or divider wall (not shown) to define a below-freezing, or freezer, compartment 24 and a fresh food, or above-freezing, compartment 26. Each of the compartments 24 and 26 comprises a refrigerated storage space, as is well known.

The freezer compartment 24 is accessible through an access opening (not shown). A freezer door 28 selectively closes the freezer compartment access opening. Similarly, the fresh food compartment 26 includes an access opening (not shown). A fresh food door 30 selectively closes the fresh food compartment access opening.

With reference to FIGS. 2–4, the freezer door 28 includes an outer door panel or shell 32 and an inner door panel or liner 34. The outer shell 32 is typically formed of metal in the configuration of a parallelepiped having an outer rectangular panel 36 connected to four inwardly turned side panels 37–40. Each of the side panels 37–40 is connected to a return inwardly facing peripheral flange 42 surrounding a rectangular opening 44. The outer panel 36, together with each of the side panels 37–40 and flange 42, defines a generally C-shaped channel 46 surrounding an inner space 48. The space is accessible through the opening 44.

The liner 34 is of unitary molded plastic construction. The liner 34 has a peripheral flange 50 in registry with the shell flange 42, as discussed below. The liner 34 also includes a central wall portion 52 connected to the flange 50 via a pair of vertical, inwardly projecting sidewalls 54 and 56 and opposite horizontal, inwardly projecting top and bottom walls 58 and 60, respectively. As used herein, the term "inwardly" relates to the disposition from the shell outer panel 36 extending toward the liner 34, and "outwardly" vice-versa. As is particularly illustrated in FIG. 4, the sidewalls 54 and 56 are generally U-shaped in cross-section and open outwardly into the shell space 48. The sidewalls 54 and 56 are commonly known as dikes, used for supporting conventional shelf structure.

In the illustrated embodiment, the central wall portion 52 is provided with a plurality of horizontally extending shelf walls 62 extending between the vertical sidewalls 54 and 56. Also included is an ice dispenser chute housing portion 64 for delivering ice bodies from an automatic ice making and dispensing apparatus (not shown) to an ice dispenser 65 mounted on the freezer door 28, see FIG. 1. The particular configuration of the central wall portion 52 depends upon the desired shelf configuration for any particular refrigeration apparatus 20.

In accordance with the invention, the space 48 is filled with a body 66 of rigid insulation. The body of insulation 66 adheres to both the liner 34 and the door shell 32 for securing the liner 34 to the door shell 32. Alternatively, or additionally, fasteners such as screws may be used to fasten the liner flange 50 to the shell flange 42. In accordance with the invention, the insulation body 66 comprises an in situ foam insulation which expands and cures with the door shell 32 and liner 34 preassembled and with a gasket 68 received on the liner flange 50 for sealing against the refrigerator cabinet 22 when the door 28 is closed. The insulation body 66 substantially fills the space 48 between the liner 34 and shell 32 to provide improved insulation in the freezer door 28.

When the space 48 is filled with polyurethane foam during the insulation process, a bimetal effect takes place as the door cools, which can cause the door 28 to bow longitudinally. Also, bowing can occur when the door 28 is cooled during normal operation of the refrigerator/freezer 20. To reduce bowing, first and second beams 70 and 72 are fit in vertical sides of the channel 46 along opposite vertical side panels 38 and 40, see FIG. 4. Particularly, each beam 70 and 72 is of C-shaped cross-section, similar to the channel 46, and is of a size slightly smaller than the corresponding size of the channel 46 to be held therein with an interference fit. The thickness of the material of the beams 70 and 72 is approximately 0.040 inches. The length of the beams 70 and 72 extends substantially the full height of the door 28. This reinforcement might allow a reduced gauge steel for the shell 32 and allows post drilling of handle screw holes, thus allowing a common door assembly for different handle configurations. After curing, the insulation body 66 prevents movement of the beams 70 and 72.

In order to further reduce bowing, the liner 34 is provided with a flexible geometric shape so that it can flex and stretch to accommodate thermal contraction from the bimetal effect without causing the door shell 32 to bow.

Particularly, the first vertical sidewall 54 is provided with longitudinally spaced scallops 74 and 76 at select longitudinal positions. The second vertical sidewall 56 is provided with corresponding scallops 78 and 80, also at the select longitudinal positions and aligned with the respective scallops 74 and 76.

As particularly illustrated in FIG. 2, each of the scallops 78 and 80, and also 74 and 76, comprises a notch in the form of a V-shaped indentation opening inwardly The central wall portion 52 includes first and second transverse inwardly opening recessed grooves 82 and 84. The first groove 82 extends between the scallops 74 and 78. The second groove 84 extends between the scallops 76 and 80. Particularly, the grooves 82 and 84 are longitudinally aligned with the narrowmost portion of the respective scallops 78 and 74 and 76 and 80.

The scallops 74, 76, 78 and 80 allow bending of the liner 34. The recessed grooves 82 and 84 provide an expansion joint at the longitudinal positions at which this bending occurs to control bowing.

The described structure for reducing thermal bow is illustrated in connection with a freezer door 28 of a side-by-side refrigerator/freezer 20. Similar structure could also be used in the fresh food door 30 or in similar doors for a top or bottom mount refrigeration apparatus or stand-alone refrigerator or freezer.

Thus, the invention broadly comprehends a refrigeration apparatus door in which a pair of C-shaped beams and the geometry of the liner are configured to reduce thermal bowing.

I claim:

1. In a refrigeration apparatus cabinet defining a storage space, a door providing selective access to said space comprising:

an outer door panel; and an inner door panel having a peripheral flange, said peripheral flange being fastened to said outer door panel and including a central wall connected between a pair of vertical, inwardly projecting sidewalls, each of said sidewalls including a scallop in the form of an inwardly opening notch at a select aligned longitudinal position of the inner door panel, said notch having an outward depth extending substantially to said peripheral flange such that said sidewall is absent in said select aligned longitudinal position, and said central wall including a transverse inwardly opening recessed groove extending between said sidewalls at the select longitudinal position to provide an expansion joint.

2. The door of claim 1 wherein said inner door panel comprises a unitary molded plastic panel.

3. The door of claim 1 wherein each said notch comprises a V-shaped indentation.

4. The door of claim 3 wherein said groove is longitudinally aligned with a narrowmost portion of said indentation.

5. In a refrigeration apparatus cabinet defining a storage space, a door providing selective access to said space comprising:

an outer metal shell having an outer rectangular panel connected to four inwardly turned side panels connected to an inwardly facing peripheral flange;

an inner liner having a peripheral flange in registry with said outer metal shell flange, a central wall and a pair of vertical, inwardly projecting sidewalls connecting said central wall to said inner liner flange, each of said sidewalls including a scallop in the form of an inwardly opening notch at a select aligned longitudinal position of the inner liner, said notch having an outward depth extending substantially to said peripheral flange such that said sidewall is absent in said select aligned longitudinal position, and said central wall including a transverse inwardly opening recessed groove extending between said sidewalls at the select longitudinal position to provide an expansion joint.

6. The door of claim 5 wherein said inner liner comprises a unitary molded plastic liner.

7. The door of claim 5 wherein each said notch comprises a V-shaped indentation.

8. The door of claim 7 wherein said groove is longitudinally aligned with a narrowmost portion of said indentation.

9. The door of claim 5 wherein each of said sidewall includes a second scallop in the form of an inwardly opening notch at a second select aligned longitudinal position of the inner liner, and said central wall includes a second transverse inwardly opening recessed groove extending between said sidewalls at the second select longitudinal position to provide a second expansion joint.

10. The door of claim 5 wherein said liner sidewalls are generally U-shaped in cross section and open outwardly toward the shell.

11. The door of claim 5 further comprising a body of insulation disposed between said shell and said liner.

12. The door of claim 5 further comprising a body of in situ foam insulation substantially filling a space between said shell and said liner.

13. In a refrigeration apparatus cabinet defining a storage space, a door providing selective access to said space comprising:

an outer metal shell having an outer rectangular panel connected to four inwardly turned side panels connected to an inwardly facing peripheral flange to define an interior space;

a pair of elongate C-shaped beams disposed at opposite sides of said interior space in registry with opposite vertical ones of said side panels; and an inner liner having a peripheral flange in registry with said outer metal shell flange, and defining a space therebetween, a central wall and a pair of vertical, inwardly projecting sidewalls connecting said central wall to said inner liner flange, each of said sidewalls including a scallop in the form of an inwardly opening notch at a select aligned longitudinal position of the inner liner, said notch having an outward depth extending substantially to said peripheral flange such that said sidewall is absent in said select aligned longitudinal position, and said central wall including a transverse inwardly opening recessed groove extending between said sidewalls at the select longitudinal position.

14. The door of claim 13 further comprising a body of insulation disposed in said space between said shell and said liner.

15. The door of claim 13 wherein said beams are of a size in cross section slightly smaller than a corresponding size of said interior space in cross section and said beams are held in said channel with an interference fit.

* * * * *